United States Patent [19]

Seilly

[11] 4,003,013

[45] Jan. 11, 1977

[54] ELECTROMAGNETIC DEVICES

[75] Inventor: Alec Harry Seilly, North Wembley, England

[73] Assignee: Simms Group Research & Development Limited, Birmingham, England

[22] Filed: Mar. 4, 1976

[21] Appl. No.: 663,829

Related U.S. Application Data

[63] Continuation of Ser. No. 552,801, Feb. 25, 1975, abandoned.

[52] U.S. Cl. ..... 335/220; 335/266

[51] Int. Cl.[2] ..... H01F 7/08

[58] Field of Search ..... 335/220, 221, 223, 224, 335/225, 226, 227, 228, 250, 261, 266, 279, 255, 281; 310/27

[56] References Cited

UNITED STATES PATENTS

| | | | |
|---|---|---|---|
| 3,335,659 | 8/1967 | Schacht et al. | 335/266 |
| 3,353,040 | 11/1967 | Abbott | 310/27 |

*Primary Examiner*—Harold Broome
*Attorney, Agent, or Firm*—Andrus, Sceales, Starke & Sawall

[57] ABSTRACT

An electro magnetic device comprises a pair of relatively movable magnetizable members which have surfaces disposed in face to face relationship. One of the members is provided with spaced projections which locate in spaced slots formed in the other member, the projections having a smaller width than the slots so as to permit limited relative movement between the members. Some or all of the slots accommodate an electrical winding, the connection of the winding or windings being such that any two slots in which the flow of current in the windings therein is in the same direction are separated by a slot with either no winding or with a winding in which the flow of current is in the opposite direction. When the winding or windings are energized and when the projections are not centrally disposed in the slots, the members will be urged relative to each other to reduce the size of the smaller gap between each projection and the side face of the associated slot.

18 Claims, 8 Drawing Figures

ELECTROMAGNETIC DEVICES

This is a continuation, of application Ser. No. 552,801, filed Feb. 25, 1975 now abandoned.

This invention relates to electromagnetic devices comprising a pair of relatively movable magnetizable members and a winding or windings through which can be passed an electric current to produce a magnetic field to effect relative movement of the members.

The object of the invention is to provide such a device in a simple and convenient form.

According to the invention in a device of the kind specified, one of said members defines a plurality of slots disposed in side by side relationship on one face of the one member, the other member defining a plurality of projections entering into the slots respectively and of a smaller width than the slots, some or all of said slots accommodating an electrical winding, the connection of the winding or windings being such that any two slots in which the flow of current in the windings therein is in the same direction are separated by a slot with either no winding or with a winding in which the flow of current is in the opposite direction, the arrangement being such that if the members are positioned so that the projections are not centrally disposed in the slots, the members will be urged relative to each other in an attempt to reduce the size of the smaller gap between each projection and the side faces of the associated slot.

According to another aspect of the invention in a device of the kind specified, one of said members defines a plurality of slots disposed in side by side relationship on one face of the one member, the other member defining a plurality of projections entering into the slots respectively, said projections being of a smaller depth than the slots and also of smaller width, each of said slots accommodating an electrical winding, the connection of the windings being such that the flow of electric current in the winding in one slot will be in one direction only, and the flow of current in the winding in an adjacent slot will be in the opposite direction, the arrangement being such that if the members are positioned so that the projections are not centrally disposed in the slots the members will be urged relative to each other in an attempt to reduce the size of the smaller gap between the projections and the side faces of the slots.

According to a further feature of the invention the depth and shape of the slots is such in relation to the projections as to provide accommodation for the windings.

According to a further feature of the invention one of said members is of cylindrical form and the other member is of annular form, said slots and projections being defined by screw threads formed on the presented surfaces of the members.

According to a further feature of the invention the screw thread is a two or a multiple of two, start thread, said winding or windings being connected such that the current in the windings in alternate thread grooves is in one direction and either there is no winding in the other thread grooves or if windings are present then the current flow is in the opposite direction.

One example of an electromagnet device in accordance with the invention will now be described with reference to the accompanying drawings, in which.

The design requirements for the device include a low inertia of the moving parts, a high mechanical force output and high speed operation.

Figure 1:
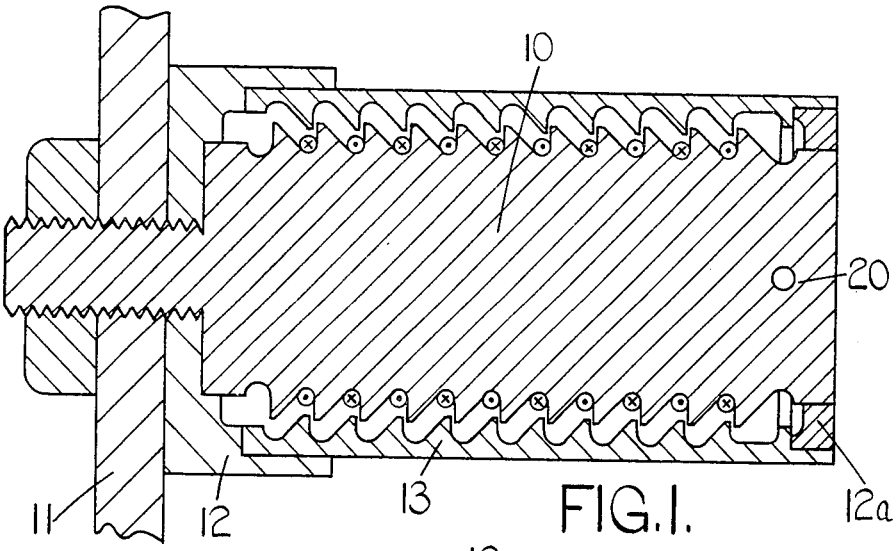
FIG. 1 is a sectional side elevation of the device.
Figure 2:
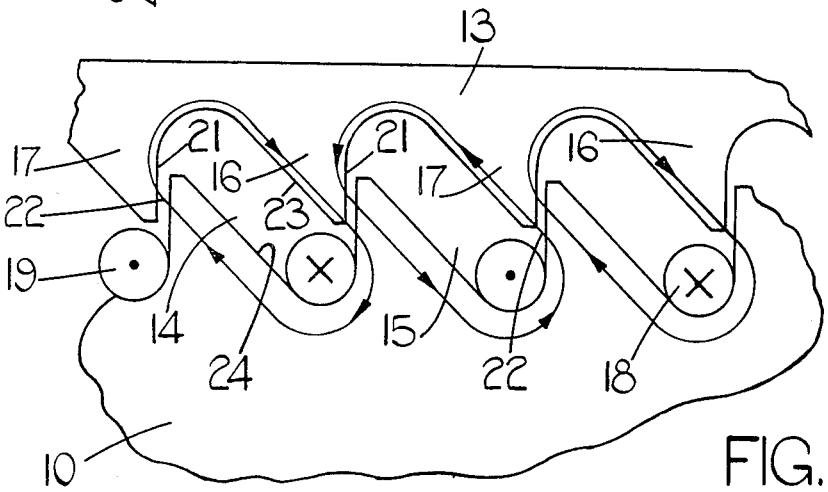
FIG. 2 is an enlarged section of a portion of the device seen in FIG. 1.

With reference now to FIGS. 1 and 2 of the drawings the device comprises a central core member 10 which at one end is provided with a threaded stud whereby it can be secured to a support member 11. Disposed between the core member and the support member 11 is a cup shaped part 12 through an aperture in the base wall of which extends the stud. The cup shaped part 12 acts to locate an annular member 13 about the core member 10, whilst at the same time allowing limited axial movement between the members. At the opposite end a bearing sleeve 12*a* locates the two members relative to each other.

The core member 10 and the annular member 13 are formed from magnetizable material. Moreover, the core member 10 is provided with slots into which enter projections formed on the annular member. In practice, and as shown, the members are provided with interengageable screw threads, the threads being formed so that appreciable relative axial movement can take place between the members. For reasons which will be explained, the threads formed on the members are two start threads although it will be understood that any multiple of two threads may be used. That is, there will always be even start threads. It will be seen that the core member 10 in the case of a two start thread, is provided with two helical slots 14, 15 whilst the annular member 13 is provided with two helical projections 16, 17 disposed in the slots 14, 15 respectively. In the example of FIGS. 1 and 2 the threads on the two members are of identical cross section. This is not essential as will be seen in the remaining figures. It is nevertheless convenient for the purpose of description to talk about slots and projections and the use of the term slot will be confined to the threads on the member upon which windings are wound.

As shown in FIGS. 1 and 2 each slot 14, 15 in the core member 10 is provided with a winding 18, 19 in this case a winding having a single turn. For the purpose of understanding, in FIG. 1 the dot and cross indication is used to represent the respective windings and in FIG. 2 whilst indicating the respective windings, the dot and cross indication also indicates the direction of electric current flow. The two windings 18, 19 are formed from a continuous length of insulated wire which is wound away from one end of the core member 10 conveniently the stud end of the core member, along one thread through a transverse aperture 20 at the other end of the core member and back along the other thread towards said one end of the core member.

The shape of the threads formed on the two members is important. The projections 16, 17 have radially extending side faces 21 which in the de-energised condition of the winding are disposed in spaced parallel side by side relationship to side faces 22 defined by the slots. The other faces 23 of the projections 16, 17 incline outwardly and the other faces 24 of the slots incline in a similar manner. The axial spacing between the faces 24, 23 is considerably larger than the spacing between the faces 21, 22.

When electric current is passed through the wire, each winding 18, 19 produces a magnetic flux which follows a path through the core member 10 across the two gaps defined between the faces 21 and 22 and through the member 13. The two members therefore strive to move relative to each other to reduce the size and reluctance of the gaps and a mechanical force is created. It will be noted that because of the different direction of the windings 18, 19 the direction of the flux generated due to each winding is opposite. However, for any one of said gaps the direction of the flux flowing across the gap due to the two windings, is the same. The flux generated by the two windings therefore has an additive effect. The path for leakage flux for instance between the faces 23, 24 is maintained as large as possible by suitable choice of the configuration of the threads and by the pitch of the threads.

Figure 3:
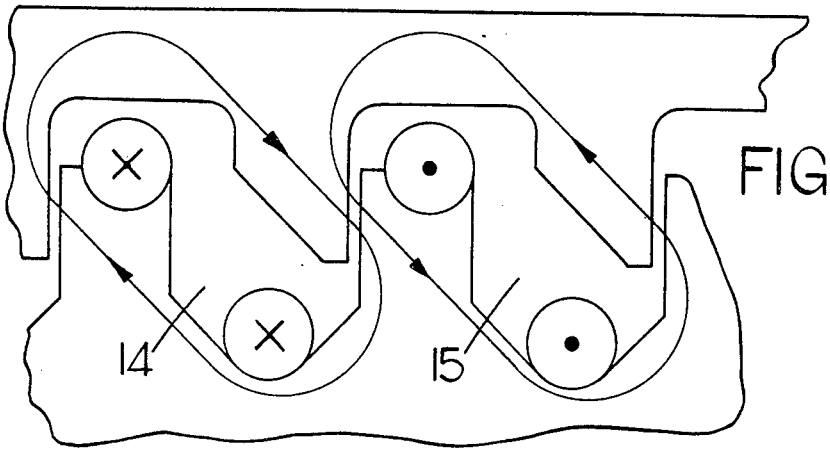
FIGS. 3, 4, 5 and 6 are views similar to FIG. 2 and show alternative arrangements of the device of FIG. 1.

In the arrangement shown in FIG. 3 each winding is provided with two turns and these may be connected in parallel or in series. If the series arrangement is desired a single length of wire may be used for both windings. FIG. 3 also demonstrates the point made earlier namely that the threads on the two members need not be of identical cross section. With the arrangement shown in FIG. 3 there may be more leakage of flux due to the shorter gaps between the various faces.

Figure 4:
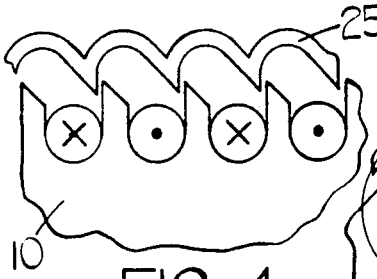

In the arrangement which is shown in FIG. 4 the annular member 25 has been made thinner and lighter by trimming away all surplus material so that the member is as light as possible so as to reduce its inertia. Material can be removed in this fashion because in practice the flux does not penetrate very far into the magnetisable material. However, in order to produce a high mechanical force the flux density across the gaps between the faces 21, 22 should be as high as possible and therefore the flux should penetrate the material as much as possible. The flux penetration depends on the type of material, the amplitude of the flux and also the rate of change of flux. In conventional devices of this type, laminated materials are often used to achieve greater flux penetration. This is not necessary with the present design even with a high flux density and with high rates of change of flux providing a suitable material is chosen. Such a material would have a high electrical resistivity and a low magnetic permeability such as a sintered pure iron for example that sold under the name "Hoganas." An alternative material would be a linear ferrite material.

Figure 5:
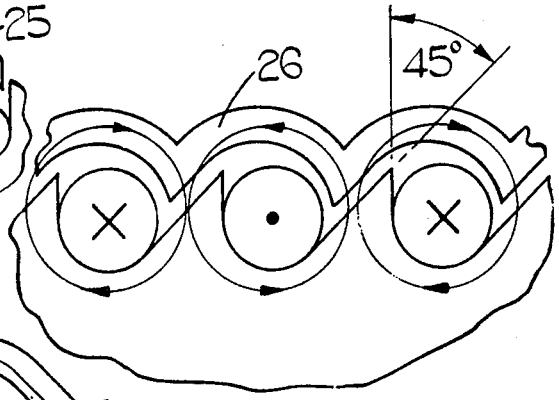

The arrangement shown in FIG. 5 also uses as thin an annular member 26 as possible. Moreover, the slots in the core member are as small as possible and are more or less completely filled with copper. The flux path is also as small as possible but it is to be noted that the gaps between the faces of the projections and slots are inclined and therefore the axial force acting to move the members in a relative axial direction will be reduced. Furthermore, the location of the core member 10 and the annular member 26 is rather critical because of the proximity of the windings to the projections and because of the smaller clearances employed in the construction.

Figure 6:
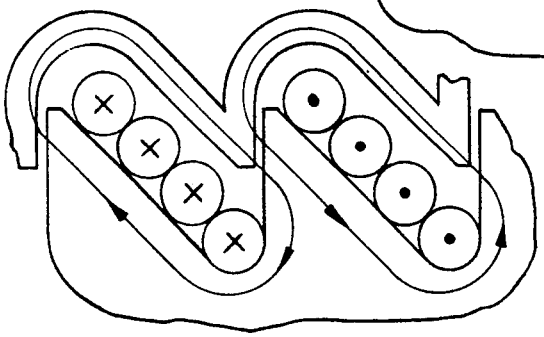

The arrangement shown in FIG. 6 is in many respects similar to the arrangement shown in FIG. 2 with the annular member modified as shown in FIG. 4. In addition, each winding is provided with four turns.

Figure 7:
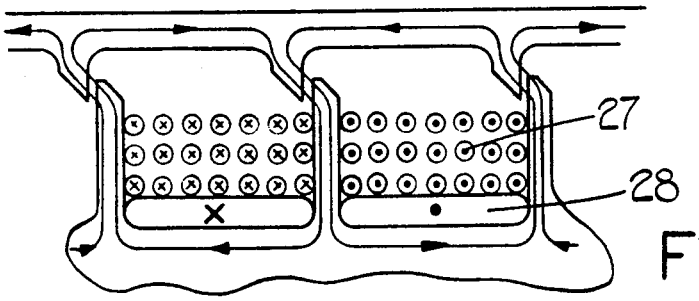
FIG. 7 shows a further modification of the device.

In the arrangement shown in FIG. 7 each slot is provided with a pair of windings 27, 28. The winding 27 can be energised before the winding 28 so as to provide a steady base flux. This base flux would not in practice be of sufficient magnitude to cause movement of the part actuated by the device, but would effect partial saturation of the material forming the core and annular members. When movement of the part is required the current is supplied through the winding 28 and because of the lower effective permeability of the material the depth of penetration of the flux is higher thereby leading to a high flux density in the gaps.

Figure 8:
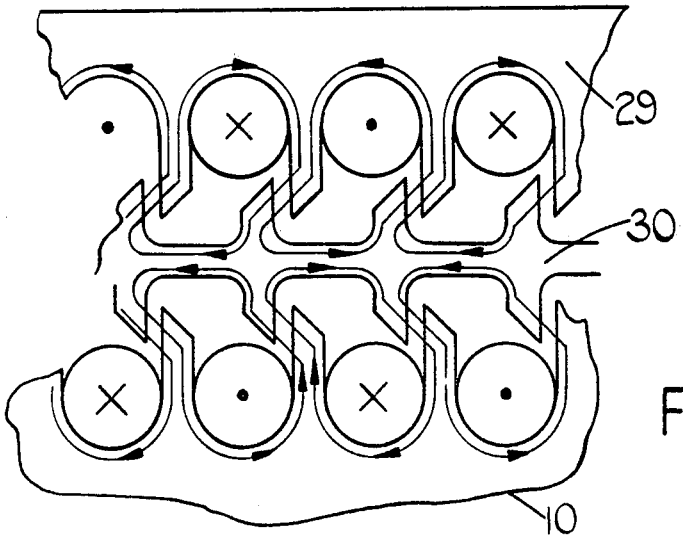
FIG. 8 shows a further arrangement of the device.

In the examples described the slots including the windings have been formed in the core member. It will be understood, however, that the slots and windings could have been formed in the annular member. In FIG. 8 there is shown an example in which slots are formed on the internal periphery of an annular member 29. In this case, however, there is also a core member 10 and disposed between these members is a movable member 30 having the projections formed thereon and which are positioned in the respective slots of the members 10 and 29.

In each of the examples described, the flux penetration may be increased by cutting axial slots along the peripheral surfaces of both the core member and annular member.

In each of the examples described each slot as defined by a thread groove is provided with a winding. It is possible, however, to provide a single winding in one only of the thread grooves. Moreover, in the case of a multiple of two start threads, two of the thread grooves may be provided with windings and if the current in the windings is in the same direction then there must be an empty thread groove disposed therebetween. If on the other hand the flow of current in the two windings is in the opposite direction, then the grooves accommodating the windings must be adjacent each other.

In each of the examples described the helical air gaps across which the axial pulling force is developed are equal. When the gaps are reduced to zero upon relative axial movement of the members there is the risk that the faces defining the gaps will stick to each other due to the action of residual magnetism. The resulting holding force can be reduced by machining the members such that the faces defining one gap only can move into contact with each other.

Moreover, the devices described are single acting only. That is to say the members forming the device move relatively to each other in one direction only when the winding is energised. A double acting effect can be obtained by providing two such devices as described in back to back relationship. In this case the winding of one device would be energised to achieve relative movement in one direction and the winding of the other device to achieve movement in the opposite direction.

In the case of the device shown in FIG. 8 it is possible to achieve the double acting effect by a comparatively simple modification. It should be noted however that the two windings are then energised separately to achieve the two directions of movement. The modification is to dispose the projections on one side of the member 30 on the opposite side of the ribs of the adjacent member 10 or 29.

In the devices described since the projections and slots are helically disposed, in addition to the axial force which is generated upon energisation of the winding there will also be a turning force. The magnitude of this force will depend upon the helix angle and the members must be mounted so as to resist this force. The turning force can however be balanced by providing a further device having the opposite helix angle but arranged to pull in the same axial direction when the winding is energised.

The devices described have employed a member 10 of solid form. It is advantageous for the member 10 to be of tubular form with the wall thickness as small as possible. The actual thickness of the wall being sufficient to transmit the magnetic flux. In this manner eddy current loss in the member 10 can be reduced.

I claim:

1. An electromagnetic device comprising a pair of relatively movable magnetisable members and an electrical winding means through which can be passed an electric current to produce a magnetic field to effect relative movement of the members, in which one of said members defines a plurality of slots disposed in side by side relationship on one face of the said one member, the other said member defining a plurality of projections entering into the said slots respectively and of a smaller width than the slots, at least some of said slots accommodating said electrical winding means, the connection of the winding means being such that any two slots in which the flow of current in the winding means therein is in the same direction are separated by a slot with a winding means in which the flow of current is in the opposite direction, the arrangement being such that if said members are positioned so that said projections are not centrally disposed in said slots, the members will, upon current being passed through said winding means, be urged relative to each other in an attempt to reduce the size of the smaller gap between each projection and the side faces of the associated slot.

2. An electromagnetic device comprising a pair of relatively movable magnetisable members and an electrical winding means through which can be passed an electric current to produce a magnetic field to effect relative movement of the members, in which one of said members defines a plurality of slots disposed in side by side relationship on one face of the said one member, the other said member defining a plurality of projections entering into the said slots respectively, said projections being of a smaller depth and width than said slots, each of said slots accommodating said electrical winding means, the connection of the winding means being such that the flow of electric current in the winding means in one slot will be in one direction only, and the flow of current in the winding means in an adjacent slot will be in the opposite direction, the arrangement being such that if said members are positioned so that said projections are not centrally disposed in said slots, the members will, upon current being passed through said winding means, be urged relative to each other in an attempt to reduce the size of the smaller gap between the projections and the side faces of the slots.

3. A device according to claim 2 in which the depth and shape of said slots is such in relation to the size of said projections as to provide accommodation for said winding means.

4. A device according to claim 2 in which one of said pair of members is of cylindrical form and the other of said pair of members is of annular form, said slots and projections being defined by screw threads formed on the presented surfaces of said pair of members.

5. A device according to claim 4 in which the screw thread is an even start thread.

6. A device according to claim 5 in which said winding means comprises a single length of wire.

7. A device according to claim 6 in which said wire is wound in one groove towards one end of the member and returns in an adjacent groove towards the other end of the member.

8. A device according to claim 7 in which said wire passes through an aperture formed in the member in which the grooves are formed.

9. A device as claimed in claim 7 in which a plurality of turns are provided in each groove.

10. A device as claimed in claim 5 in which each groove is provided with a pair of windings, one of which can be energised to partly magnetize the members, and the other of which can be energised to magnetize the members a further amount to cause relative movement of the members.

11. A device according to claim 4 in which said other of said pair of members is thinly formed on its outer periphery to reduce the thickness of material and thereby reduce the inertia of the member.

12. A device according to claim 4 in which said other of said pair of members is provided with projections on its outer peripheral surface and a third annular member is provided surrounding said other of said pair of members, said third annular member having helical slots machined on its internal periphery in registry with the projections on the outer surface of said other of said pair of members, said one of said pair of members and said third member each mounting windings.

13. A device as claimed in claim 12 in which the windings on said one of said pair of members and on said third member, when energised, effect movement of said other of said pair of members in the same direction.

14. A device as claimed in claim 12 in which the windings on said one of said pair of members and on said third member, when energised, effect movement of said other of said pair of members in opposite directions respectively.

15. The combination of a pair of devices as claimed in claim 5 in which the respective devices are coupled together so that energisation of the electrical windings of one of the devices will result in relative axial movement of the devices in one direction and energisation of the windings of the other of the devices will result in relative axial movement of the devices in the opposite direction.

16. The combination of a pair of devices as claimed in claim 5 in which the respective devices are coupled together, the helix angles of the projections and grooves of one of the devices being opposite to those of the other device so that the turning force generated between the members of each device when the windings are energised is cancelled.

17. An electromagnetic device comprising a pair of relatively movable magnetisable members and an electrical winding means through which can be passed an electric current to produce a magnetic field to effect relative movement of the members, in which one of said members defines a plurality of slots disposed in side by side relationship on one face of the said one member, the other said member defining a plurality of projections entering into the said slots respectively and of a smaller width than the slots, said winding means including windings in a pair of adjacent slots, the connection of the windings being such that the flow of current in the windings in the pair of adjacent slots is in the opposite direction, the arrangement being such that if said members are positioned so that said projections are not centrally disposed in said slots, the members will, upon current being passed through said windings, be urged relative to each other in an attempt to reduce the size of the smaller gap between each projection and the side faces of the associated slot.

18. A device according to claim 17 in which the depth and shape of the slots is such in relation to the size of the projections as to provide accommodation for the windings.

* * * * *